US006302624B1

(12) United States Patent
Nasu et al.

(10) Patent No.: US 6,302,624 B1
(45) Date of Patent: Oct. 16, 2001

(54) METHOD FOR EJECTING GROUND IMPROVING GROUT INTO GROUND

(75) Inventors: Takeo Nasu, Tokyo; Kazuhiro Watanabe, Saitama Prefecture, both of (JP)

(73) Assignee: Kyokado Engineering Co., Ltd. (JP)

( * ) Notice: Subject to any disclaimer, the term of this patent is extended or adjusted under 35 U.S.C. 154(b) by 0 days.

(21) Appl. No.: 09/114,874

(22) Filed: Jul. 14, 1998

(30) Foreign Application Priority Data

Jul. 14, 1997 (JP) ..... 9-202589

(51) Int. Cl.[7] ..... E02D 5/18
(52) U.S. Cl. ..... 405/269; 405/266
(58) Field of Search ..... 405/269, 266, 405/267, 268, 256, 150.1, 150.2; 417/338, 342, 344, 515, 516, 517

(56) References Cited

U.S. PATENT DOCUMENTS

| | | | | |
|---|---|---|---|---|
| 2,061,425 | * | 11/1936 | Karstens | 417/516 X |
| 3,298,322 | * | 1/1967 | Sherrod | 417/517 |
| 3,299,643 | * | 1/1967 | Mauclet | 405/269 X |
| 3,540,837 | * | 11/1970 | Pascucci | 405/269 X |
| 3,608,318 | * | 9/1971 | Levy et al. | 405/269 X |
| 3,682,575 | * | 8/1972 | Guddal et al. | 417/517 |
| 3,800,544 | * | 4/1974 | Nakanishi | 405/266 |
| 4,036,564 | * | 7/1977 | Richards | 417/344 |
| 4,072,017 | * | 2/1978 | Shiraki | 405/270 |
| 4,084,381 | * | 4/1978 | Cain et al. | 405/266 |
| 4,214,628 | * | 7/1980 | Botts | 166/75 R |
| 4,449,856 | * | 5/1984 | Tokoro et al. | 405/269 |
| 4,451,180 | * | 5/1984 | Duval | 405/269 |
| 4,470,771 | * | 9/1984 | Hall et al. | 417/342 |
| 4,652,180 | * | 3/1987 | Jenkins | 405/269 |
| 4,900,196 | * | 2/1990 | Bridges | 405/267 |
| 5,061,158 | * | 10/1991 | Egli | 417/532 |
| 5,118,223 | * | 6/1992 | Taki | 405/267 |
| 5,399,055 | * | 3/1995 | Dutton, Jr. | 405/257 X |
| 5,542,782 | * | 8/1996 | Carter, Jr. et al. | 405/267 X |
| 5,634,779 | * | 6/1997 | Esysmontt | 417/342 |
| 5,860,907 | * | 1/1999 | Kauschinger | 405/269 X |
| 6,109,836 | * | 8/2000 | Gritti | 405/266 |

FOREIGN PATENT DOCUMENTS

55155815 * 12/1980 (JP) .

* cited by examiner

*Primary Examiner*—David Bagnell
*Assistant Examiner*—Jong-Suk Lee
(74) *Attorney, Agent, or Firm*—Banner & Witcoff, Ltd.

(57) ABSTRACT

When an improving material used for ground improving construction is ejected into the ground, an improving material having a predetermined gel time is ejected through a vast number of points simultaneously or selectively from ejection ports provided in improving material transport passages such that the positions of the ejection ports are offset. The improving material can be ejected through the vast number of points as designed. A stroke, start and stop of an advancing and retreating movement adjusting device can be adjusted through a screw of the advancing and retreating movement adjusting device. A slide guide as a supporting mechanism is fitted to a slide bar so that even if a load deviated with respect to a piston rod is applied. The piston can be advanced and retreated smoothly, and an automatic on-off valve is interposed in the piston so that the improving material can be intaken and discharged smoothly. Since the improving material can be charged from the ejection ports through a vast number of points, it is possible to form a ground improved area having the same properties without deviation. The construction can be carried out as designed, the construction efficiency and accuracy can be enhanced, the cost is reduced, a resource can be saved, and the pollution can be prevented.

5 Claims, 14 Drawing Sheets

PRIOR ART

PRIOR ART

METHOD FOR EJECTING GROUND IMPROVING GROUT INTO GROUND

BACKGROUND

1. Field of Invention

The present invention relates to a construction technique for charging an improvement material such as a grout or the like into a soft ground through a vast number of points.

2. Related Art

As is known, in Japan which is small country and has a special landform in which a large number of mountains, forests and fields lie adjacent to complicatedly mixed coastline in which a large number of mountains, forests and fields, and flat land which can be utilized not only for farming and cattle breeding, but also for housing, constructing various industrial institutions, schools, hospitals, laboratories is limited. Therefore, it is an extremely important problem for a long time in Japan to effectively utilize the land. For this purpose, in order to spread the flat land which can be effectively utilized, searches and developments have been made for reclaiming valleys such as rivers, lakes and marshes, as well as soft grounds such as around shallow sea shores, for improving grounds for effectively utilizing the above described areas. Recently, practical results have been obtained, and some of them have been put to practical use.

Ground improving methods of construction such as sand drain and calcium oxide were used in times past, but they were complicated and expensive. Therefore, a ground improving method of construction has been widely used recently as shown in FIG. 21 in which a casing pipe is directly passed into the ground. An improving material such as grout is ejected and charged into the ground from a predetermined ejection port formed in the casing pipe during a process or the like for pulling up the improving material from a predetermined depth while rotating the casing pipe, and the improving material is concreted in the ground to form the improved area with passage of time. In the ground improving method of construction of the above described type, an insertion apparatus 3 allows the casing pipe 2 to bore and pass into the ground 1. A grout 9 which is the predetermined improving material is pumped into the casing pipe 2 through a swivel joint 7 from a grout tank 6 by a single-cylinder pump 5 which is controlled and driven by a generator 4. Also during the process of pulling the casing pipe 2, the grout 9 is ejected and charged into the ground 1 from a nozzle type ejection port 8 formed at a tip end of the casing pipe 2, thereby improving the ground.

Various improvements and developments have been repeatedly made. These improvements include ejecting and charging the grout of the above type into the ground 1 using a so-called double-pipe double-packer charging method as shown in FIG. 22. This includes a technique in which an antecedent bore 10 is formed in the ground by a casing pipe, and an inner pipe 12 made of synthetic resin or the like having a sleeve 11 coaxially fitted therearound is inserted into the antecedent bore 10. A sealing mortar 13 or the like is charged between the inner pipe 12 and the antecedent bore 10, and packers 14 and 14 are disposed in the inner pipe 12 at a predetermined pitch to contact the packers 14 and 14, contact an inner surface of the inner pipe 12 under pressure. A predetermined improving material 9 such as grout is pumped from a grout tank 6 by pumps 5' between the packers 14 and 14, and the improving material 9 is ejected and charged from an ejection port 8 of the inner pipe 12 through a slit of the sleeve 11 and the sealing mortar 13, thereby constructing a predetermined improved area.

As such a double-pipe double-packer charging method, a so-called strainer pipe charging method and a Soletanshu charging method are known.

In the conventional methods for ejection and charging the improving material 9 into the ground 1 as shown in FIGS. 21 and 22, since the improving material 9 is ejected from a spot-like ejection port by the pumps 5 and 5', and since a nozzle diameter of the ejection port 8 is small, a dynamic pressure of the improving material ejected from the ejection port 8 becomes high, and a crack is generated in the ground 1 of the improved area around the ejected improving material 9. Additionally there are drawbacks that the ground 1 swells or rises, or that the improving stratum is deformed depending on properties of the ground 1.

To cope with the drawback, as indicated in inventions of Japanese Patent Application Laid-open Nos.H6-212620 and 6-33446 (Japanese Patent Publication No.H8-30332), and Japanese Patent Application Laid-open No.7-300849 shown in FIGS. 23 and 24, a predetermined antecedent bore 10 is previously formed in the ground 1 by a casing pipe. Improving material transportation passages 16 each having a small diameter and provided at their tip ends with laterally directed ejection ports 15 whose opening positions are different in a longitudinal direction are previously banded together and inserted into the antecedent bore 10 as shown in FIG. 24. The improving material transportation passages 16 are connected to an improving material tank 6 through a valve 17 and a header 18. The pump 5 is connected to the improving material tank 6 through a compressor 19 and a controller 20. A predetermined small amount of an improving material 9 is charged into the ground at a low pressure through a sealing mortar 13 charged in the antecedent bore 10. By charging the improving material 9 through many points by the low pressure penetrance, no crack is generated, and techniques capable of stably improving ground are developed, and some of them have been put to practical use.

However, if the above described charging-through many points is used for the ground improvement technique of transportation passage, since the ejection ports 15 of the improving material transportation passage 16 are offset in a vertical direction and the improving material 9 is supplied under pressure by the single-cylinder pumps 5", the ejection dynamic pressures of the improving material should be different from one another due to the properties of the ground corresponding to the ejection port 15. Instead, an ejection mode by the same dynamic pressure must be employed. Therefore, although there is a merit that the grout 9 as the improving material is charged into a wide improving area through many points simultaneously, there is a drawback in that a difference is generated in the improved degree in the improved area. Further, since the pumping pressures by the single-cylinder pumps 5" are the same, even if the discharge pressures of the pumps 5 are set different, the ejection pressures at all of the ejection ports 15 are basically reach limits, and there is a problem that it is difficult to individually control the ejection ports 15. Further, there is a demerit that even if the discharge pressures are set different depending on differences in depth of the ejection ports 15, there is a limitation in design for setting the ejection pressure from the ejection ports 15 at different values depending on depth.

Although a technique for interposing a pressure pot between the header 18 and the improving material tank 6 is developed, since pressure adjustment by interposing the pressure pot must be conducted for all of the ejection ports 15, it is difficult to adjust the ejection pressure of each of the ejection ports 15 in accordance with the properties of the ground which differ depending on the positions of the ejection ports 15.

Although the system includes the single-cylinder pumps 5", the system itself must includes the compressor 19, the controller 20 and the like, which are expensive. Further, the control, management, and operational maintenance are extremely complicated.

As a conditioner charging pump, although there is a multi-cylinder pump such as three cylinder type, in the present case, the pump only includes a smoothing function in order to avoid a variation in charging operation due to pulsation of conditioner charging by each of the cylinders (or pistons), and there is a demerit that the above prior art does not include a function capable of totally or partially selecting the charging operation through many points, especially through a vast number of points.

OBJECT AND SUMMARY OF INVENTION

An object of the present invention is to overcome the problem that it is difficult to effectively adjust the ejection pressure of each of the ejection ports, while keeping the merit of the charging method through many points in the ground improving technique by ejecting the improving material based on the above-described conventional technique. Using the multi-cylinder pump, the above problem, a method capable of selecting individual or sequential charging of the material through a vast number of points into each of blocks of ground simultaneously or selectively, is solved. The present invention provides an excellent charging method through a vast number of points into the ground which has merit for a field utilizing civil engineering in the construction industry, and providing a device which is directly used for the method.

To achieve the above object, in the present invention of this application having a subject matter as described in the claims, when charging through a vast number of points is conducted for improvement construction work or the like with respect to portions of ground having different properties in a vertical or lateral direction for every stratum, the ground is locally divided into the predetermined number of blocks. Ejection ports of the improving material transportation passages each having a small diameter formed in each of the blocks are formed such that positions of the ejection ports are different from one another in a longitudinal direction or a lateral direction in accordance with properties of stratum of each of the blocks. The transportation passage are banded together or arranged in parallel to one another at a predetermined distance from one another, or are arranged three-dimensionally into a matrix. Each of the transportation passages is connected to a multi-cylinder unit pump of crank type, hydraulic driven type or cam-driven type. The banded transportation passage group is inserted through a sealing mortar into each of the bores of one block. The improving material is ejected into each of the stratums so that the improving material is penetrated to form a bulb-shape by a low pressure penetration, swelling of the ground or the like due to cracking is not generated. Alternatively the improving material transportation passages are separated so that the ejection ports face each of the stratums to improve the ground by the low pressure penetration with respect to the predetermined stratum. Depending on the design, the corrugated low pressure penetration is conducted to continuously connect the bulb-shaped improving areas. When the improving material ejection per block is completed, a switch valve interposed in the improving material transportation passage is switched so that the transportation of the improving material with respect to the improving material transportation passage of a block unit of the next step is switched by a control operation or manual operation, so that a ground in a predetermined area can be improved as designed.

In the multi-cylinder pump which is used, an advancing and retreating piston is provided with an automatic on-off suction valve so that the improving material is effectively pumped up and ejected. In order to prevent deflection or deformation during continuous operation of a piston rod of each of the unit pumps by a long rotating shaft in the multi-cylinder pump, a frame of the pump piston is provided with a supporting structure such as a slide guide of a bearing. A vertical swing is prevented so that the smooth retreating stroke can be obtained as designed. The piston rod is provided at its one end with a retreat movement adjusting device such as a screw so that the stroke can be adjusted. The multi-cylinder pump uses a single-cylinder driving source such as an inverter motor, or crank type, hydraulic driving type driven or cam drive type by two driving sources, each provided at one end of a shaft. Each of the unit pumps is continuously provided by one rotating shaft. Further, a pressure pot or the like is interposed between the unit pump and the transportation passage to stabilize the pressurization and a discharge amount. The system is disposed in a lateral or vertical direction in a construction site. In the multi-cylinder pump, a discharge amount of each of the unit pumps per minute is small so that the low pressure penetration can be conducted with respect to the stratum of the ground. The multi-cylinder pump comprises at least five or more unit pumps (some tens of unit pumps can be connected). If the multi-cylinder pumps is of the cam driving type, the pump should be a pump for charging through a vast number of points, and in any case, the employed pump should be a single-cylinder multi type.

The improving material transport passage is connected to a discharge port of each of the unit pumps of the multi-cylinder pump directly or through the pressure pot so that the pressing force and the discharging amount can be stabilized. By the advancing and retreating movement adjusting device provided in the piston rod, its stroke and a starting and stopping cycle is adjusted and an ejection pressure in accordance with the designed ejection of the ejection port of each of the transport passage is formed, and the low pressure penetration is conducted in accordance with each of the blocks with respect to the stratum in the bore formed in each of the blocks of the predetermined corresponding ground so that a bulb-shaped improved area is formed and cracks and swells in the ground are not generated. With respect to a specific stratum, the improving material is ejected at low pressure by the switch valve only from the ejection port of the transport passages inserted in the ground at a distance from one another in the vertical or lateral direction so that the ground is improved through the low pressure penetration in the specific stratum. Depending the design, the ground is improved such as to form a corrugate shape, or depending on a further design, a matrix-shaped three-dimensional charging is generated in the entire region of the improved ground. When the charging through a vast number of points is conducted, the stroke of each of the unit pumps of the multi-cylinder pump is freely adjusted, the stroke including start and stop of each of the unit pumps is automatically adjusted, and the ejection of the improving material is automatically adjusted. The charging through the vast number of points as designed is freely conducted for each of the plurality of blocks with respect to the wide ground. For adjusting gel time of the improving material, two pumps are necessary for one transport passage. In the case of the cam driving type, both sides of the cam are utilized, and in the case of the two pumps or more, a pump of a plurality of units with respect to one cam shaft can cope with this case, and in each of the unit pumps, the pressure process and intake process of the discharging operation can be adjusted to elongate or shorten the processes.

According to a first aspect of the invention, there is provided a charging method into a ground through a vast number of points, in which an improving material is ejected under pressure from an discharge ports formed in a plurality of improving material transport passages into a ground by a pump, wherein the plurality of improving material transport passages are disposed in at least one block, the ejection of the improving material under pressure of each of the improving material transport passages in the one block is conducted by a multi-cylinder continuously connected pump of one plant.

According to a second aspect, in addition to the first aspect, the block of the ground is formed in plural, the improving material is sent under pressure to the improving material transport passage with respect to the plurality of blocks by the multi-cylinder continuously connected pump of the one plant, and the plurality of improving material transport passages in each of the blocks can selectively be connected through a switch valve.

According to a third aspect, in addition to the first or second aspect, vertical positions of ejection ports of the plurality of improving material transport passages are offset from one another.

According a fourth aspect, there is provided a charging device into a ground through a vast number of points used in a charging method into a ground through a vast number of points for ejecting an improving material under pressure into a predetermined ground by a pump from improving material ejection ports of a plurality of improving material transport passages, wherein the pump is comprised of a multi-cylinder continuously connected pump comprising a large number of unit pumps, each of the unit pumps being connected to the improving material transport passage of a block of the ground.

According to a fifth aspect, in addition to the fourth aspect, each of the unit pumps of the multi-cylinder continuously connected pump is connected to one rotating shaft.

According to a sixth aspect, in addition to the fourth aspect, a piston and a piston rod of each of the unit pumps of the multi-cylinder continuously connected pump is operatively connected to an advancing and retreating movement adjusting mechanism, and includes a flow rate adjusting function.

According to a seventh aspect, in addition to the fourth aspect, a piston rod of each of the unit pumps of the multi-cylinder continuously connected pump has a support for preventing a vertical swinging movement due to characteristics of a cam.

According to an eighth aspect, in addition to the fourth aspect, the multi-cylinder continuously connected pump is driven by a combination of a motor and a transmission, or a hydraulic pressure.

According to a ninth aspect, in addition to the fourth aspect, a system capable of moving the piston in a longitudinal direction by a crankshaft is incorporated in the multi-cylinder continuously connected pump.

According to a tenth aspect, in addition to the fourth aspect, a pressure pot having function for stabilizing a press and a discharge amount is interposed in the multi-cylinder continuously connected pump.

According to an eleventh aspect, in addition to the fourth aspect, the multi-cylinder continuously connected pump includes five or more sets of continuously connected unit pumps, the unit pumps being arranged in a lateral or vertical direction.

According to a twelfth aspect, in addition to the fourth aspect, the unit pump of the multi-cylinder continuously connected pump includes a piston having an automatic on-off suction valve.

According to the present invention of this application, in the construction such as an improving construction of basically a soft ground such as rivers, lakes and marshes or shallow sea shores, when the already developed many point-charging is conducted as a vast number of points-charging instead of the conventional spot-charging, the vast number of points-charging can be simultaneously conducted through the low pressure penetration with respect to the ejection ports formed in the improving material transport passages such that their positions are set different in an axial direction for every block unit, or with respect to the ejection ports of the improving material transport passages disposed at a distance from one another. Further, since the gel time of the charging improving material ejected from each of the ejection ports can be adjusted, the ground can be improved simultaneously as designed.

Instead of the conventional spot-charging, the vast number of points-charging can be simultaneously or appropriately selectively conducted sequentially for every block of the ground. Therefore, a three-dimensional charging can be conducted simultaneously or selectively in a wide ground. Further, it can be conducted by the low pressure penetration. The improving material is not leaked through a swell or crack of the ground due to a crack of the ground, pollution is prevented, assets can be utilized effectively, and cost are kept low so that the construction efficiency is enhanced.

Since the charging operation can be conducted intermittently or continuously for every block, the vast number of points-charging pump of the multi-cylinder type can have at least five or more cylinders, some tens of cylinders continuously connected. Therefore, the vast number of points-charging of the improving material which has not been realized can be realized, the construction efficiency is remarkably enhanced.

Further, since the vast number of points-charging pump has five of more cylinders continuously connected, the grout is charged simultaneously through a plurality of improving material transport passages in one block unit, and the pump can operate stable as a whole.

Irrespective of the multi-cylinder continuously connected type, because of the multi-cylinder of each of the unit pumps, it can be manufactured and assembled easily, and its maintenance is also simple, and there is a merit that not only the initial cost but also the maintenance cost is cheap.

Further, in the mode of cam type, with respect to the cam connected to the rotating shaft which is connected to the driving source, a predetermined number of unit pumps are mounted to opposite sides or one cam shaft, and agent (a) and agent (b) having different gel times are for exclusive use, and distribution amount is adjusted and can be intaken or discharged and therefore, the structure is simple, and maintenance such as inspection is easy.

By providing an advancing and retreating movement adjusting device such as a screw in the cylinder of each of the unit pump, a stroke including start and stop of the unit pump can be adjusted.

When the pump rod of each of the unit pumps receives a bending stress by separating force of the driving mechanism such as a cam, a slide guide as a supporting mechanism provided in the device frame is provided on the piston rod. Therefore, the advancing and retreating movement of the pump or pump rod can be held smoothly, and the improving material is intaken or discharged as designed.

Since the piston of each of the unit pumps is provided with the automatic on-off valve as a suction valve, the intake and discharge of the improving material can be switched from the intake chamber and the discharge chamber automatically, the improving material of the unit pump is smoothly discharged, and this is extremely effective for ejection of the improving material of the ground improving construction.

By using the vast number of points-charging device of the multi-cylinder continuously connected of the present invention of this application, the improving material can be charged into a plurality of blocks formed in the ground through the vast number of points, i.e., three-dimensionally, which exhibits an excellent effect that a power can be exhibited for a project construction such as wide three-dimensional improving construction an airport.

The construction method and device of the present invention of this application can be applied not only to the mere ground improving construction, but also to a construction of marine airport, a marine crossing road, a large-scale wide tunnel construction and the like, and an effective construction can be conducted.

The above and other objects, features and advantages of the invention will become apparent from the following description of a preferred embodiment taken in conjunction with the accompanying drawings.

EMBODIMENTS

Embodiments for carrying out the present invention of the application will be explained below with reference to FIGS. 1 to 20.

Figure 21:
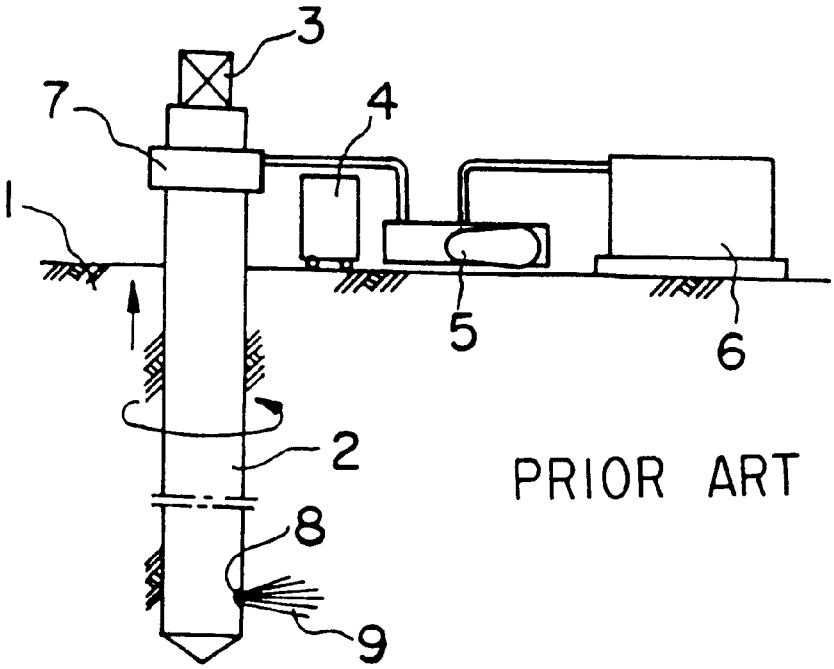
FIG. 21 is a partial sectional side view of a construction mode based on prior art.

Elements similar to those shown in FIG. 21 and subsequent figures are designated by the same reference numerals.

Figure 7:
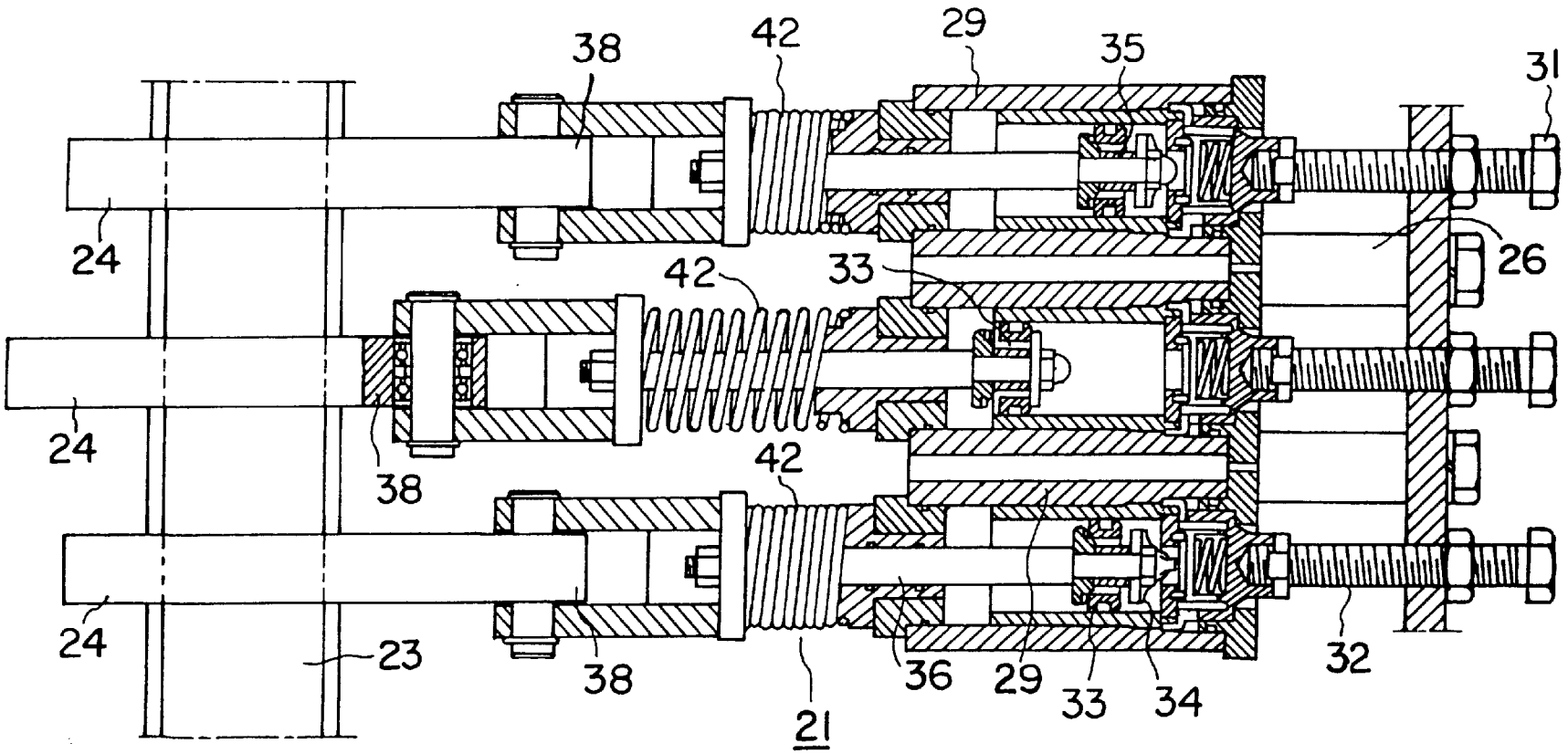
FIG. 7 is a horizontal sectional view of the unit pump.
Figure 12:
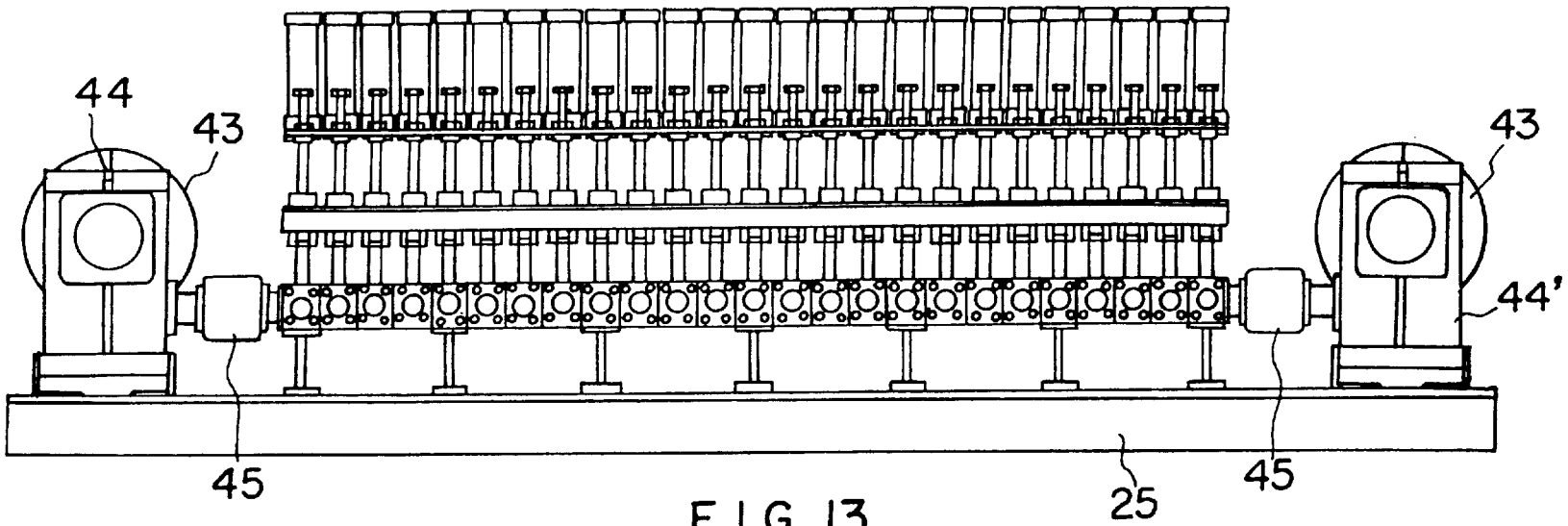
FIG. 12 is a side view of the vast number of points-charging pump of fifty cylinder-type.
Figure 13:
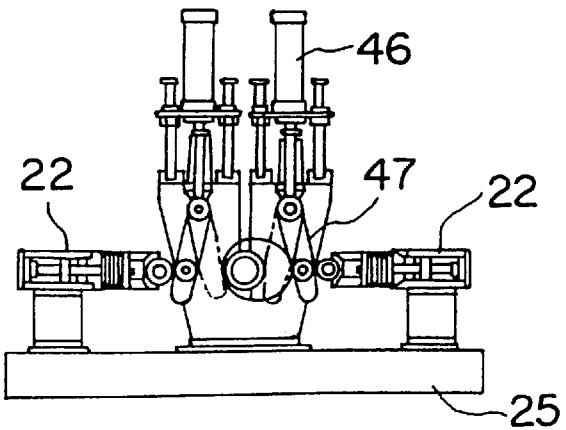
FIG. 13 is a partial sectional side view of FIG.12.
Figure 14:
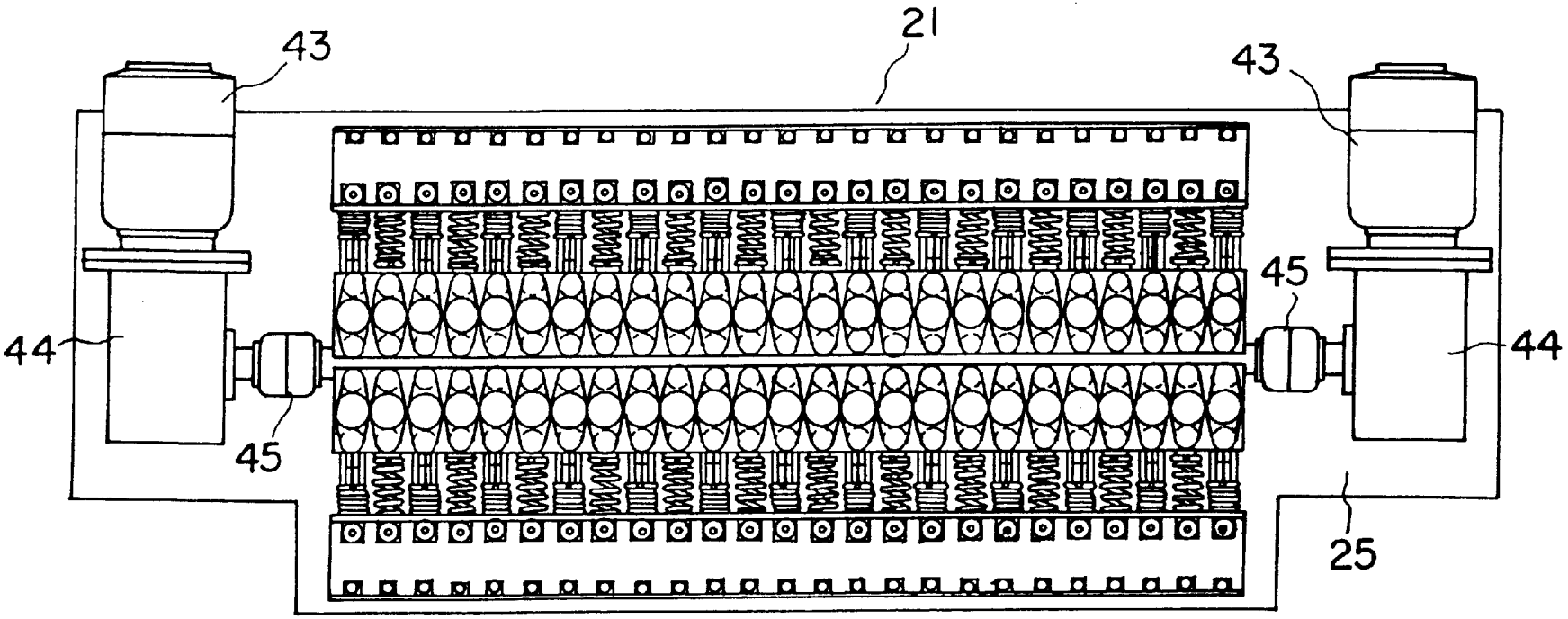
FIG. 14 is a plan view of FIG. 13.

In a mode of an embodiment shown in FIGS. 6 to 14, the reference number 21 denotes a vast number of points-charging device into a ground constituting the central point of one of subject matters of the present invention of the application, and the vast number of points-charging device constitutes a multi-cylinder pump of a pump plant, and its unit pump 22 is of a mode of cam-driven type fifty continuously connected as shown in FIG. 14, but in a mode shown in FIG. 7, a three continuously connected type is shown for the sake of convenience of illustration.

In each of the unit pumps 22, a cam 24 having a predetermined shape constituting an important constituent element of the multi-cylinder pump 21 of the invention of the application is integrally connected, which is made into the cam-driven type by the cam 24.

A cylinder 29 having an intake port 27 and an ejection port 28 of an improving material 9 such as grout is slidably mounted to a supporting bracket which is integrally formed with a base 25 of the multi-cylinder pump. Provided in the supporting bracket 30 and integrally formed with the base 25 is a screw 32 as an advancing and retreating movement adjusting device for the cylinder 29 provided at its base end with an adjusting nut 31 such that advancing and retreating movements with respect to the supporting bracket 26 can be adjusted. A piston 33 is provided with an automatic on-off valve 34 as a suction valve. An intake and discharge hole 35 formed in the piston 33 with respect to an ejection chamber and a discharge chamber provided in front and rear of a grout 9 intaken and discharged is automatically opened and closed in accordance with the advancing and retreating movement of the piston 33 so that the grout 9 of the improving material is automatically supplied to a pressure chamber of the cylinder 29.

A bracket 37 is secured to a tip end of a piston rod 36 which is integrally connected to the piston 33 and is extended forward, and the bracket 37 abuts against the cam 24 and pivotally supports a cam follower tappet 38.

The bracket 37 is integrally provided with a case 40 of a slide guide as a supporting mechanism. A large number of slide bearings 39 are provided in the case 40, and are slidably provided on a slide bar 41 which is integrally formed with the supporting bracket 26 secured to the base 25. A vertical swing, deformation and deflection of the piston rod 36 are prevented through a diagonal separating force by rotation of the cam 24, so that the piston 33 is advanced and retreated smoothly and the grout 9 is smoothly intaken and discharged.

When each of the unit pumps 22 is operated by the cam 24, by rotating an adjusting nut 31 of the screw 32 as the advancing and retreating movement adjusting device, the cylinder 29 is advanced or retreated. A stroke of the unit pump 22 is adjusted through a resilient pressure spring 42 interposed between the cylinder 29 and a mounting bracket 37 of the cam follower tappet 38 so that the cam 24 and the cam follower tappet 38 can be selectively abutted and separated, and its advancing and retreating stroke can be adjusted.

The advancing and retreating ability of the cylinder 29 is one of important mechanisms of the multi-cylinder pump 21 of the present invention of the application.

Figure 1:
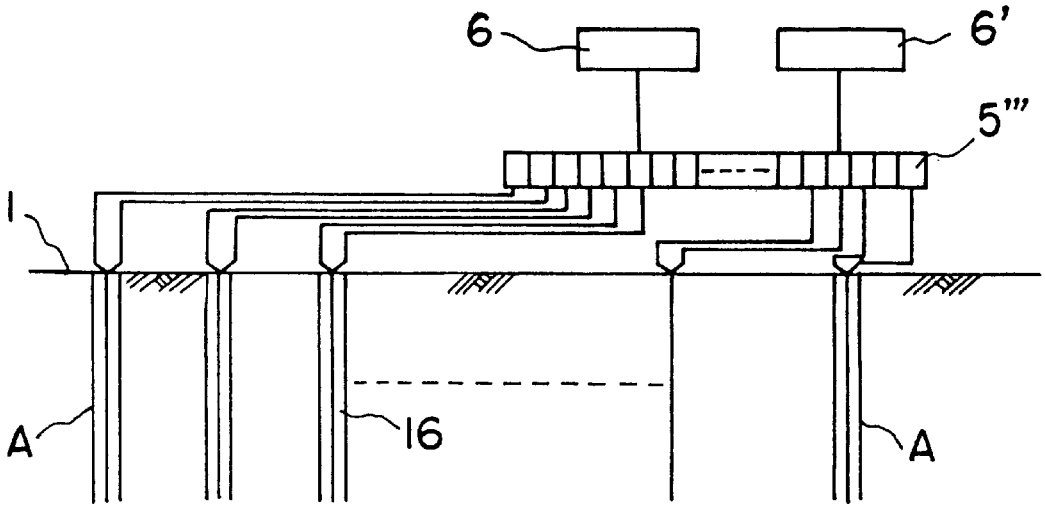
FIG. 1 is a schematic longitudinal sectional view of a first embodiment of a construction of the present invention of the application.
Figure 2:
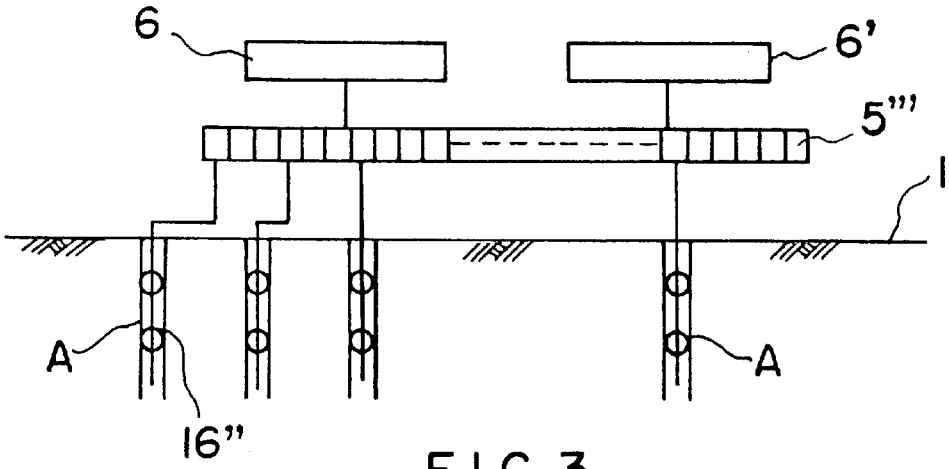
FIG. 2 is a schematic longitudinal sectional view of another embodiment of a construction of the present invention.
Figure 3:
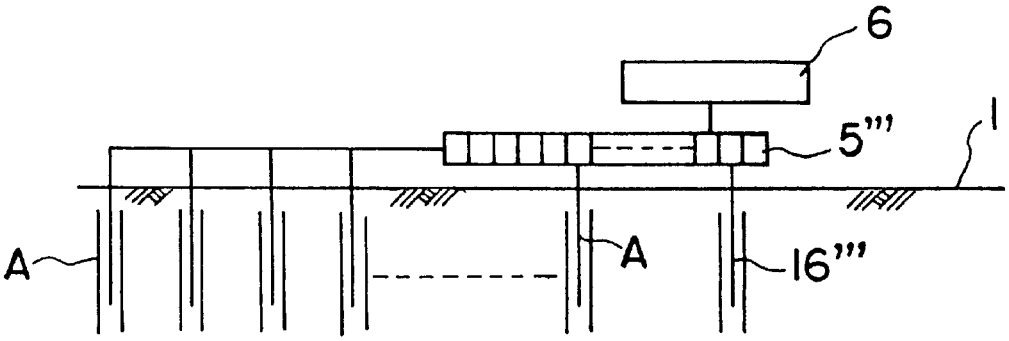
FIG. 3 is a schematic longitudinal sectional view of another embodiment of a construction of the present invention.
Figure 4:
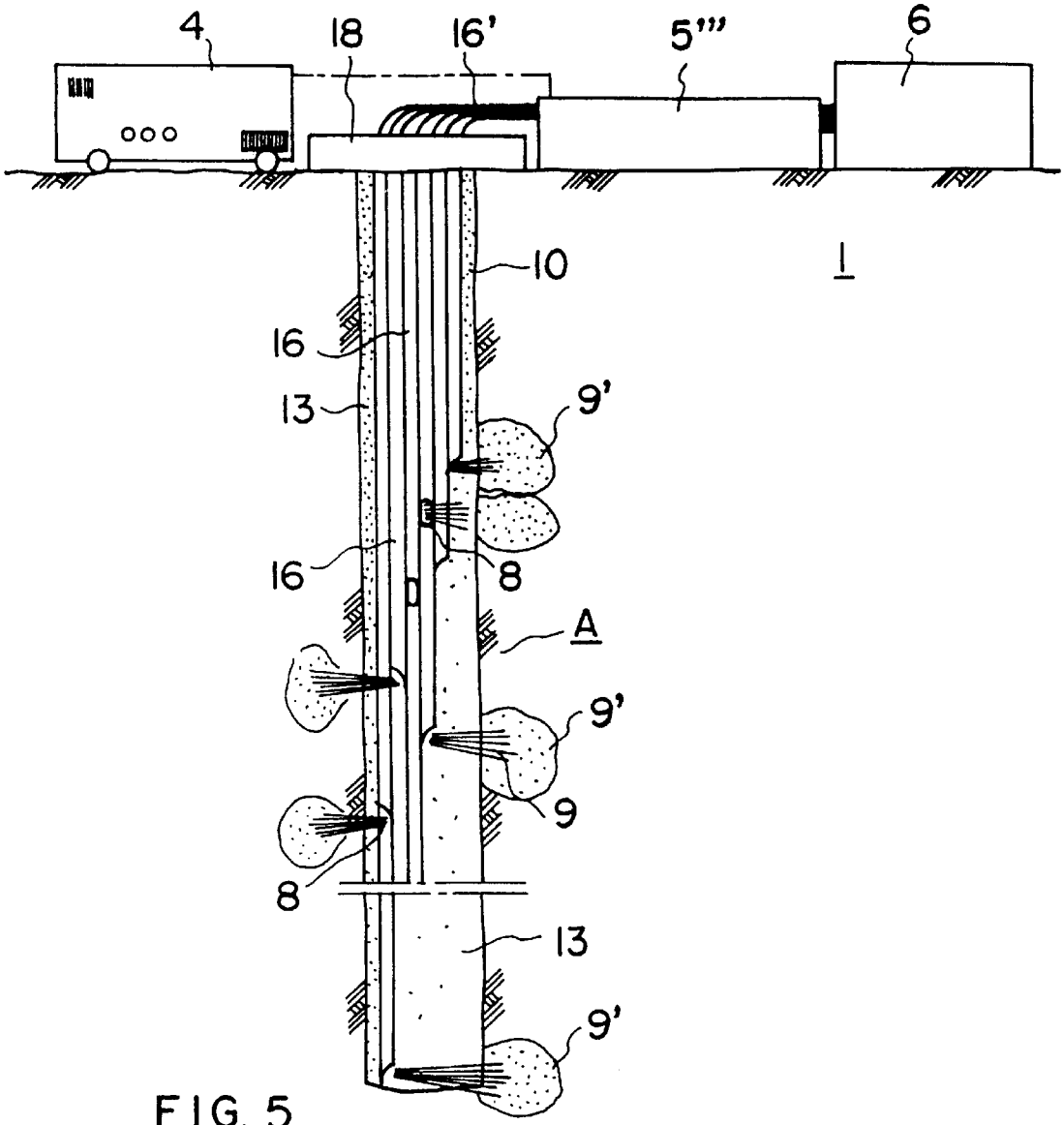
FIG. 4 is a schematic partial sectional side view of the first embodiment of a construction method of the present invention.

The ejection ports 28 of the cylinder 29 are connected to each of the improving material transport passages 16 through passages 16 and headers 18 as shown in FIG. 4 (and through a pressure pot depending on a design). When a gel time of the improving material is adjusted, a pair of unit pumps 22 are disposed in front and back cam surfaces of the cam 24, the improving material 9 in which agent (a) and agent (b) for adjusting the gel time of the grout of improving material are appropriately mixed can be sent through the intake and discharge port 27, 28 and the improving material transport passage 16 and ejected and charged into a predetermined stratum of the ground 1 from the ejection ports 8.

By appropriately selectively designing a pressing surface and a drawing surface of the cam surface of each of the cams 24 in each of the unit pumps 22 of the multi-cylinder pump, the pressing time can be elongated, the discharging time can be shortened, or reversely, discharging pressure from the ejection port 8 through the improving material transport passage 16 can be adjusted to be a high, intermediate or low speed. Additionally in the present embodiment, it is adjusted such that a small amount of material is ejected at a low speed.

Therefore, the cam 24 is an important constituent part of the multi-cylinder pump of the vast number of point-charging device of the present invention of the application.

Since five or more unit pumps 22 of the multi-cylinder pump (several hundreds of cylinders more than fifty can be connected as described above) are connected to one rotating shaft 23, there is an undesirable possibility that resonance or vibration may be generated, and that a bending stress or swing may be continuously generated in the piston rod 36 through the cam follower tappet 38 by rotating separation force of the cam 24. A supporting slide is carried out by a slide guide of the cylinder 29 through a slide bearing 39 as a supporting mechanism, deformation due to a vertical swinging movement, resonance or vibration is prevented, and the smooth ejection of the grout 9 of the improving material into the ground 1 is ensured.

This supporting mechanism is also a portion of an important mechanism of the multi-cylinder pump of the invention of the application.

Figure 8:
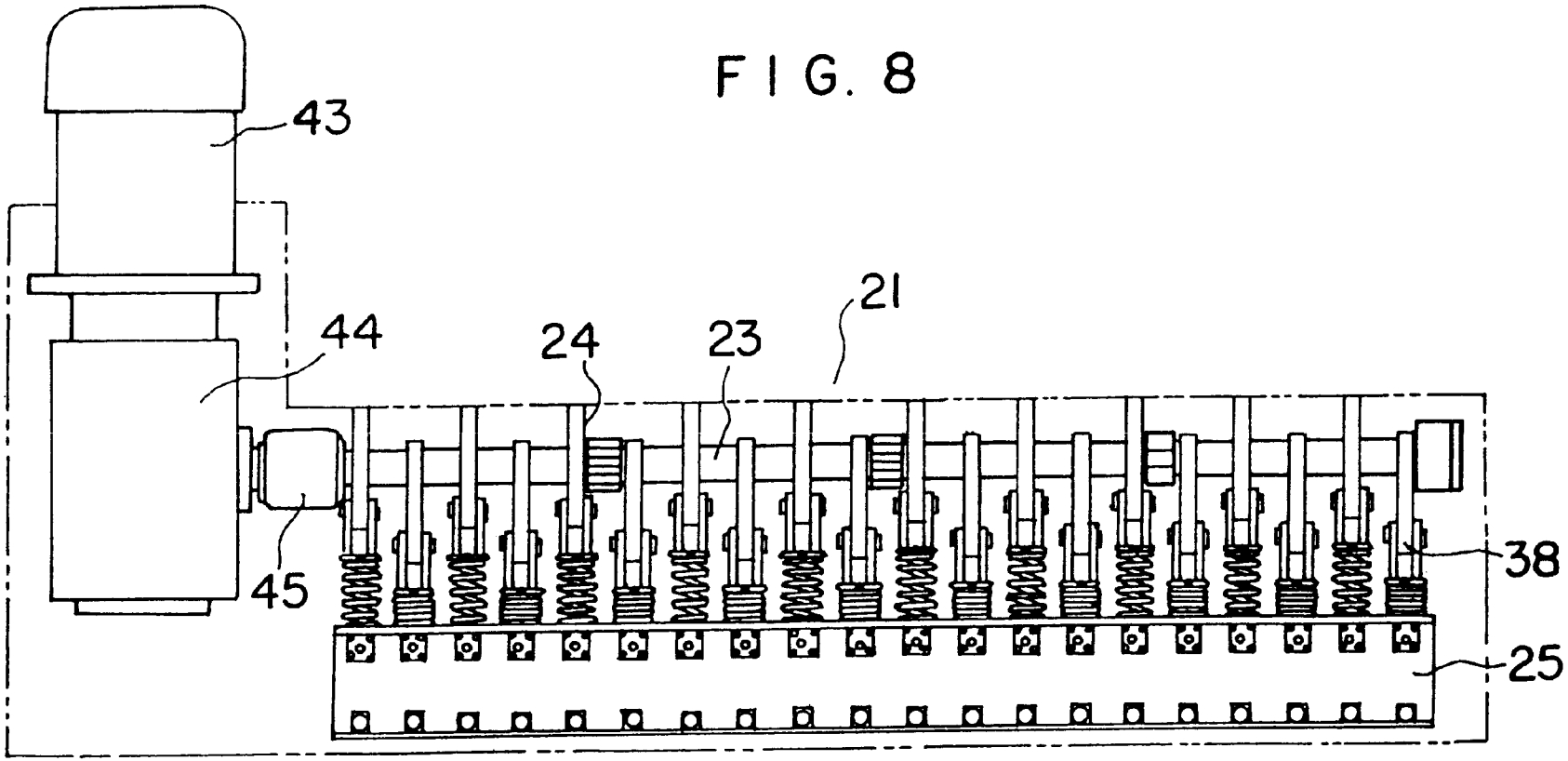
FIG. 8 is a side view of the embodiment of the horizontally mounted device according to the present invention.
Figure 9:
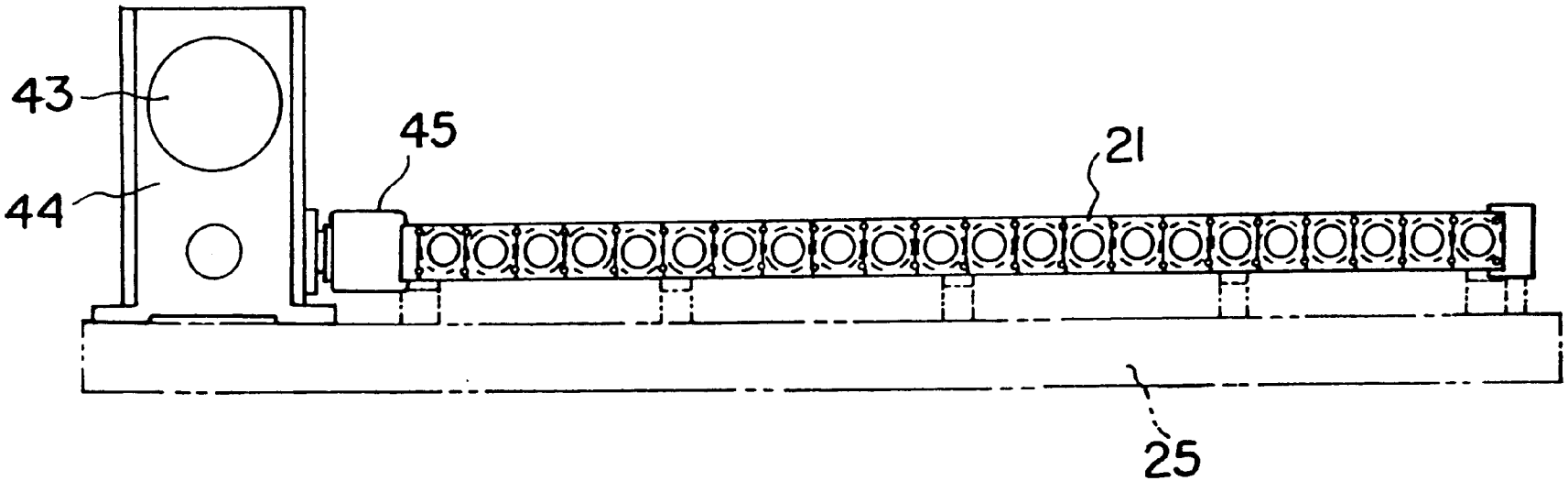
FIG. 9 is a plan view of FIG. 8.
Figure 10:
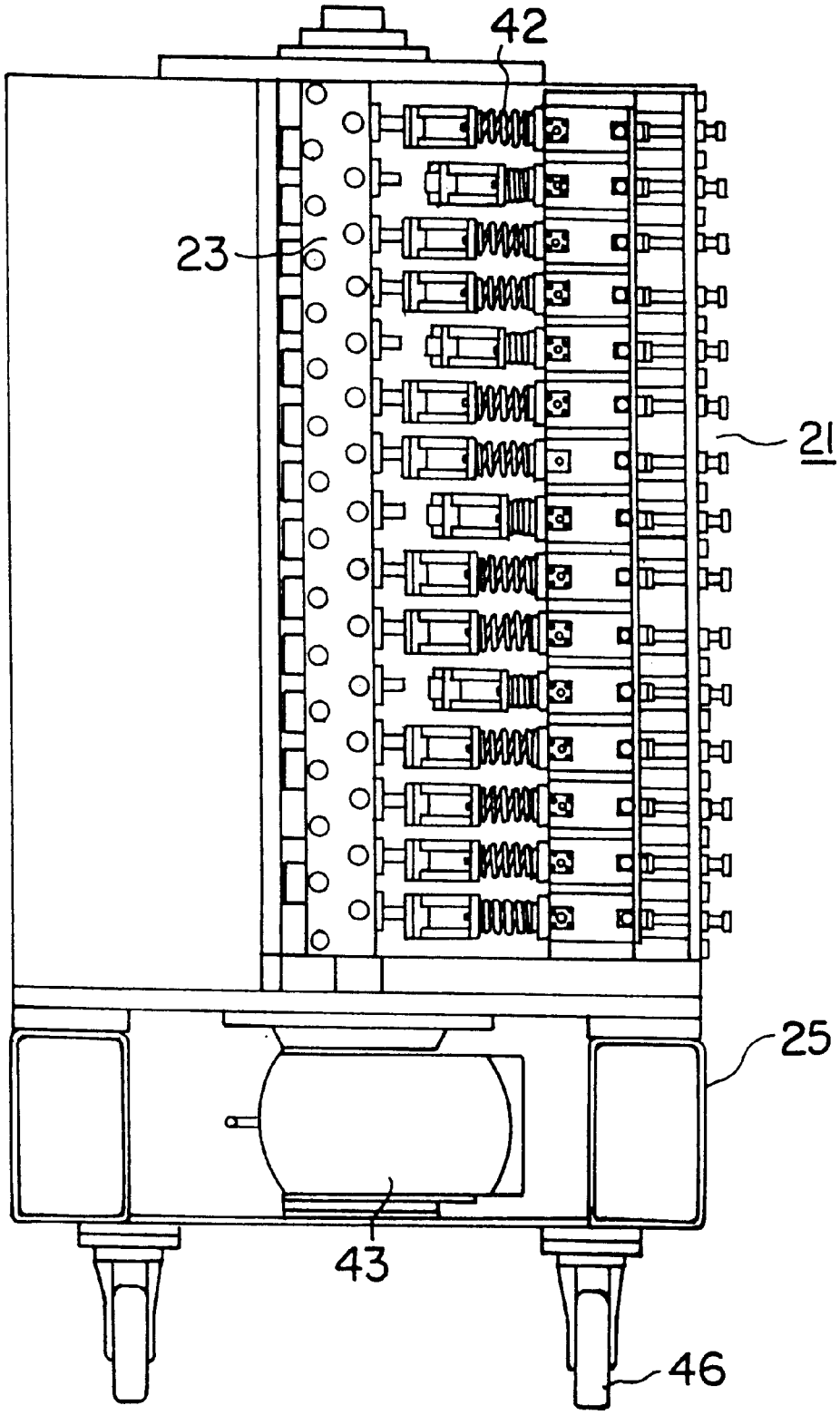
FIG. 10 is a schematic side view of the embodiment of the vertical mounted device.
Figure 11:
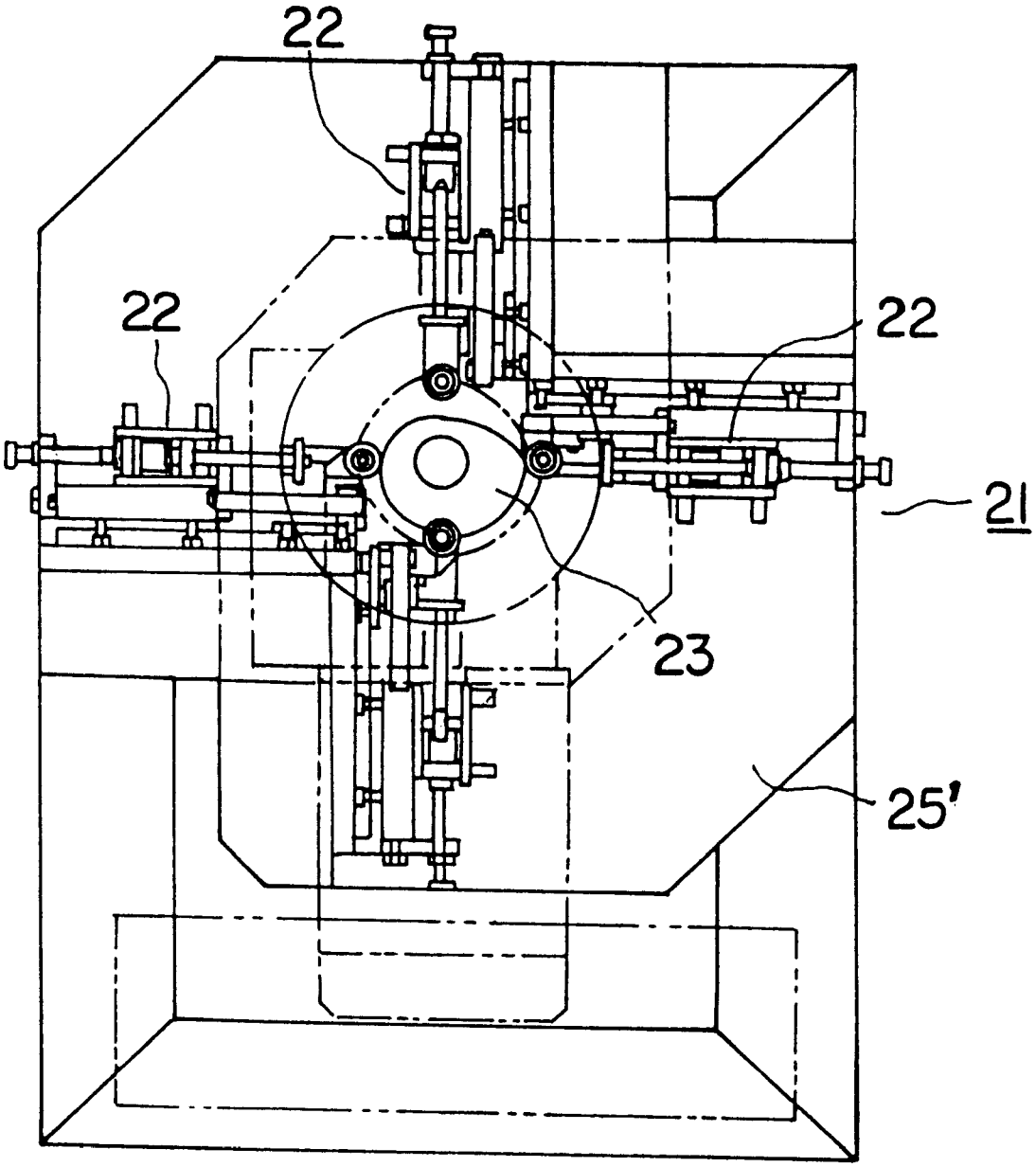
FIG. 11 is a schematic sectional plan view of FIG. 10.

In the mode of the vast number of points-charging device 21 shown in FIGS. 8 and 9, the multi-cylinder pump 22 is of a laterally disposed type which is suitable to be disposed in a region having a sufficient space. A mode shown in FIGS. 10 and 11 is a mode of the vast number of points-charging device 21 of a vertical type multi-cylinder pump as a unit plant which is easily carried in or out when an area of an installation space is small, and is a mode in which a caster roller 46 is provided under the frame 25 of the base.

Figure 15:
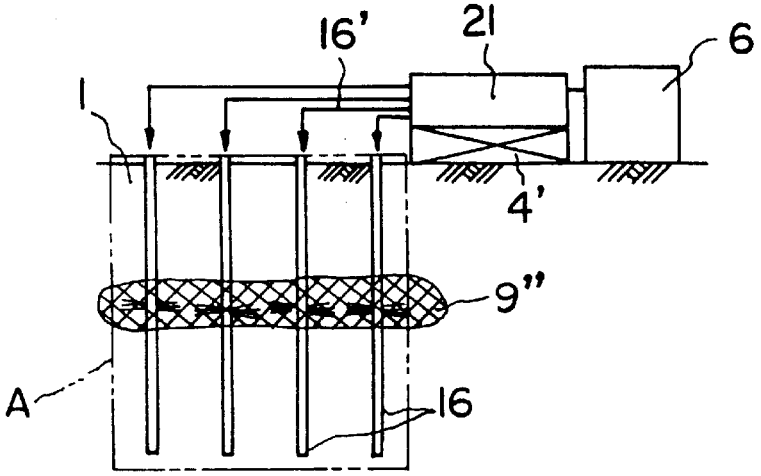
FIG. 15 is a schematic longitudinal sectional view of the invention of another embodiment of the construction.

In a mode shown in FIGS. 12 and 13, there is shown a continuous mode having a total of fifty cylinders, i.e., twenty cylinders continuously connected in each of left and right sides in the vast number of points-charging device 21 of a laterally disposed type multi-cylinder pump. In this mode, the rotating shaft 23 is long, and there is an undesirable possibility that the rotating shaft 23 can become cantileved during operation. Therefore, inverter motors 43 and 43 are symmetrically disposed on opposite ends of the rotating shaft 23 through joints 45 and speed adjusting device 44' to keep balance. In this mode, a clutch bar 47 having a tapered tip end is inserted between each of the cams 24 and the cam follower tappet 38 such that the bar 47 can be removed by an air cylinder 46, a clearance between the cam 24 and the cam follower tappet 38 is adjusted to adjust the start and stop, and the stroke of the piston 33 is adjusted to adjust the ejection amount of the grout 9 of the improving material so that the gel time is adjusted. FIGS. 14 and 15 show a mode of plan view of the multi-cylinder pump 21 of fifty cylinders.

The clutch lever 47 is also a unique mechanism of the present invention of the application.

Needless to say, the vast number of points-charging device 21 of the multi-cylinder continuous pump plant 5" is not limited to the cam-driven type, and may be of the crank-driven type or hydraulic pressure driven type.

Figure 22:
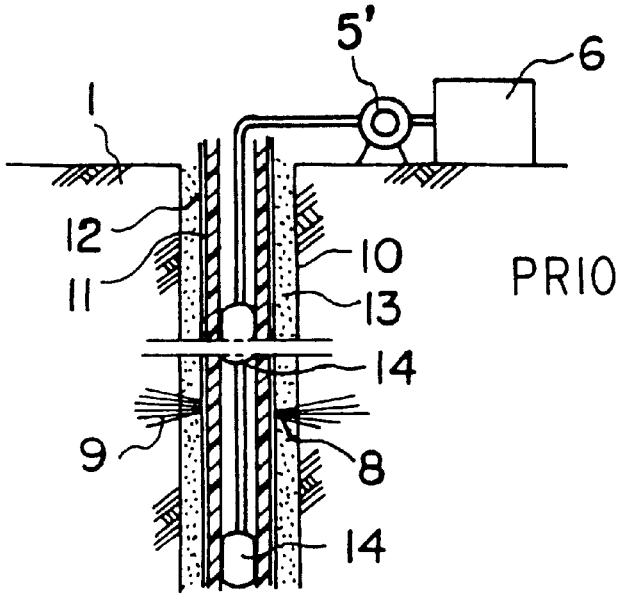
FIG. 22 is a partial sectional side view of another mode.
Figure 23:
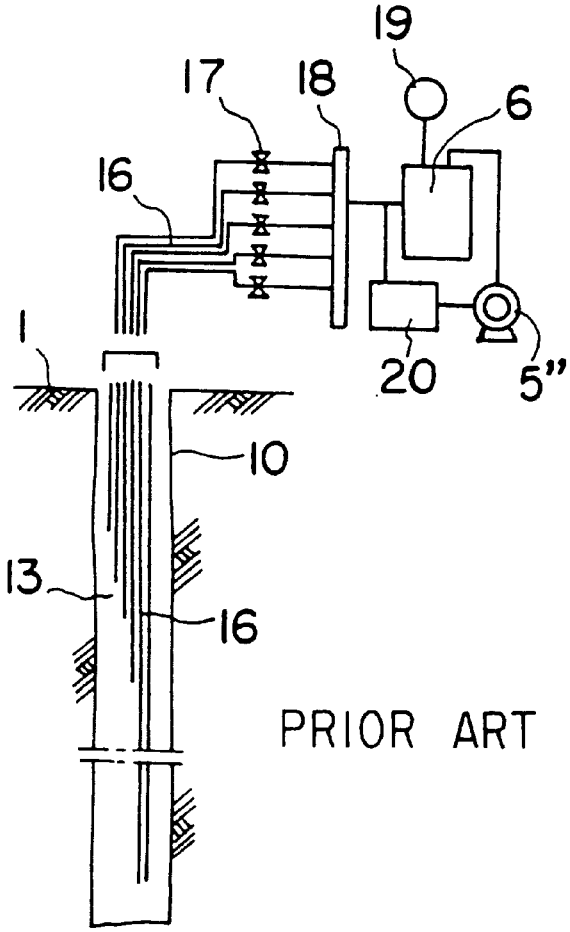
PRIOR ART FIG. 23
FIG. 23 is a partial sectional schematic side view of the another mode.
Figure 24:
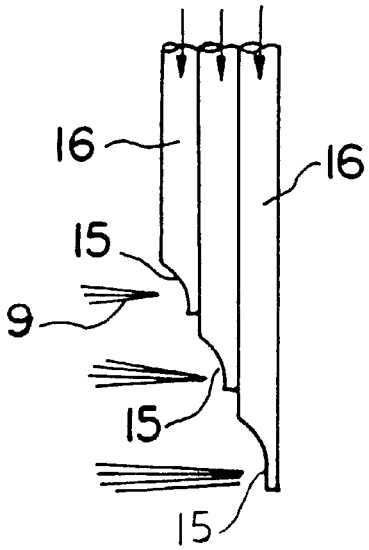
PRIOR ART FIG. 24
FIG. 24 is an enlarged side view of the ejection ports.

A basic mode for carrying out a predetermined ground improving construction by the vast number of points-charging device 21 having the above described structure as the vast number of points-charging device into the ground will be explained. First, in the basic embodiment shown in FIGS. 1 to 3 for carrying out the conventional mode shown in FIGS. 22 and 23, in the embodiment shown in FIG. 1, rods 16 of Y-shaped pipe type as the improving material transport passages are inserted into a block unit A formed by boring a predetermined hole in the ground for carrying out a predetermined vast number of points-charging operation from liquid tank 6 containing agent (a) and liquid tank 6' containing agent (b) from the pump plant 5'" to each of the rods 16. In an embodiment shown in FIG.2, improving material transport passages 16" of rode of double pipe double packer type are inserted in the bores to supply charging conditionor liquid having a predetermined gel time from A liquid tank 6 and B liquid tank 6' from the pump plants 5'" to charge the same into the ground 1. In an embodiment shown in FIG. 3, rods 16'", 16'" are of a single pipe type as the improving material transport passages are inserted into each of the blocks A. The predetermined conditioner liquid is charged from conditionor liquid tank 6 having a predetermined gel time from the pump plants 5' as the vast number of points-charging device. In those embodiments, charging operation through many points can be conducted simultaneously through the rod pipe of the Y-shaped pipe type 16, the double pipe double packer 6" or the single-pipe type rods 16'" inserted in the wide bore in each of the block units A disposed at a distance from one another. This is a basic central point of the present invention of this application.

In a specific embodiment shown in FIG. 4, a bore 10 having a predetermined depth is formed by boring into the ground using a casing pipe to form one block A. A sealing mortar 13 is ejected and charged into the bore 10. A predetermined number of improving material transport passages 16, 16 . . . which have been brought together which have a smaller diameter of several millimeters and have ejection ports 8 opened sideways of tip ends thereof, and which have been bundled in a predetermined manner such that the positions of tip ends of the improving material transport passage 16 are different from one another at axially spaced-apart predetermined distances are inserted into the bore 10 through a head 18. With respect to each of the improving material transport passage 16, a connection hose 16' as a passage is connected to the ejection port 28 of each of the unit pumps 22 of the pump plants 5''' as the vast number of points-charging device 21 through the header 18.

The pump plants 5''' are connected to the improving material tank 6 of a predetermined grout through each of the connection hoses from the intake port 27, and if a driving source of the pump plants 5''' of the multi-cylinder pump 21 is driven through a generator 4, one rotation shaft 23 is rotated to operate each of the unit pumps 22.

At that time, in each of the unit pumps 22, the cylinder 29 of the screw 32 as the advancing and retreating movement adjusting device is retreated through a predetermined stroke by the adjusting nut 31 so that the operation amounts of the cams 24 with respect to the cam follower tappets 38 are individually adjusted, thereby starting to send under pressure a small amount of the improving material 9 at a low pressure to each of the transport passages 16.

Of course, when gel time of the grout 9 of the improving material ejected from each of the ejection ports 8 is made different from one another, a stroke of the piston is adjusted, or agent (a) and agent (b) from the improving material tank 6 to the intake port 27 of each of the unit pumps 22 are connected.

Figure 5:
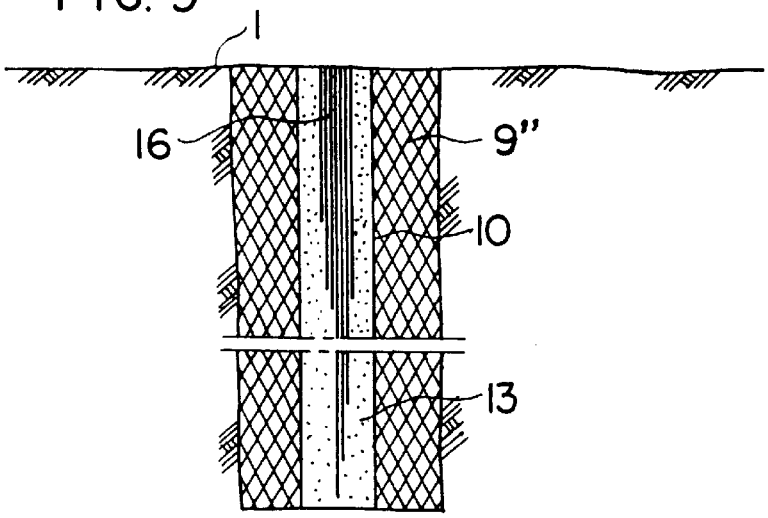
FIG. 5 is a schematic sectional view of an improved area after a construction is completed.
Figure 6:
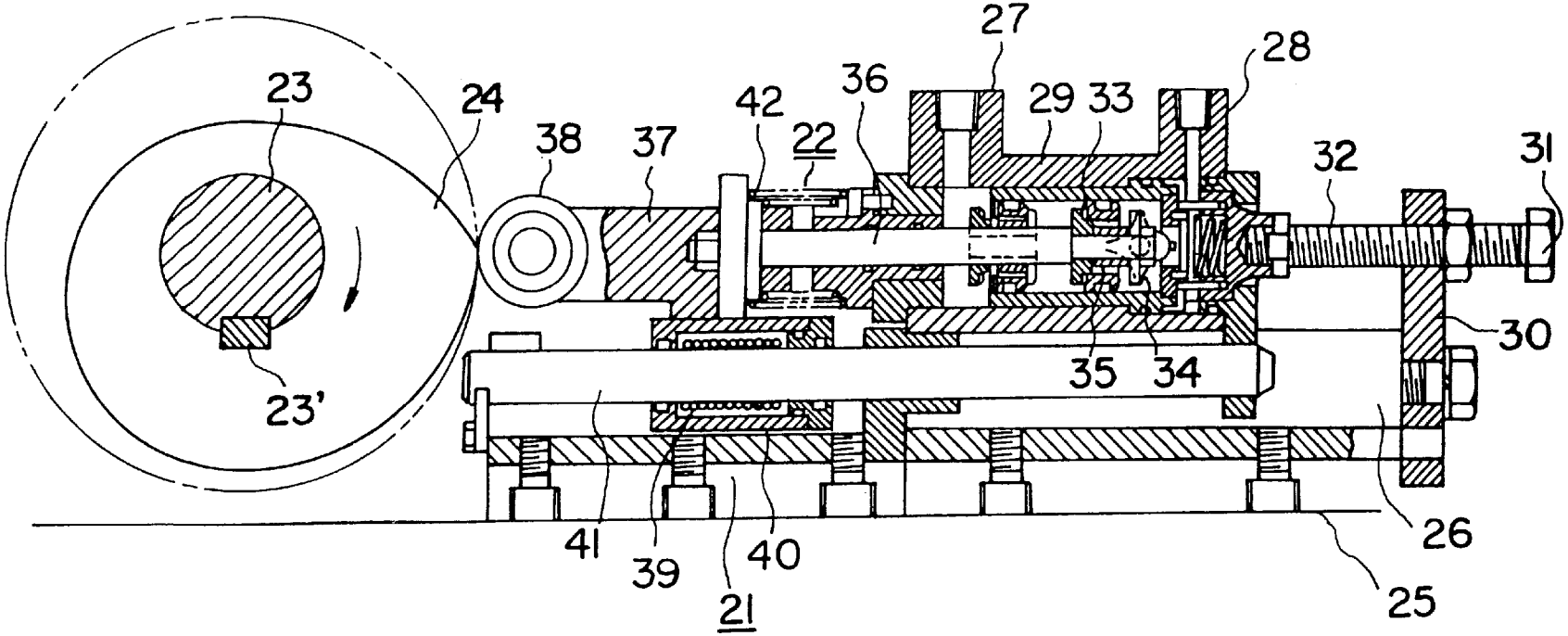
FIG. 6 is a schematic transverse sectional view of a unit pump of a vast number of points-charging pump constituting one of the subject matters of the present invention.

By doing so, from each of the ejection ports 8 of the improving material transport passages 16, 16 . . . having the bores 10 of the one block A into which the improving material transport passages 16, 16 . . . are collectively inserted, grouts 9 of the improving material having a predetermined gel time are ejected at a low pressure for penetration and are ejected into the ground 1 of a predetermined level through the sealing mortar 13 ejected and charged into the bores 10, and are connected together in terms of one block as the bulb-shaped charging grout 9'. As shown in FIG. 5, improving structures 9" as an improving area are formed at one time, the structures 9" are continuously connected in terms of one block to form a ground improving area of a region of a predetermined one block, and a continuous wall is formed in the ground to achieve the initial object.

During that time, depending on a shape of a cam surface of the cam 24, a pressing angle against the cam follower tappet 38 can be variously changed, e.g., to 140°, 270° and 300°, and an intaking angle can be variously changed, e.g., to 120°, 190° and 60°. A relative stroke of the piston 33 with respect to the cylinder 29 is adjusted by the advancing and retreating amount of the screw 32 as the advancing and retreating amount adjusting device. Various modes such as a high speed pressing, a low speed intaking, a high speed intaking and a low speed pressing can be adjusted and selected depending on the grout 9 of the improving material, a mode of the ejection and a mode of the stratum of the block A, so that the optimal ground improving construction can be carried out.

The adjusting function of the pressing is also an important mechanism of the multi-cylinder pump of the present invention of this application.

During that time, since the vast number of points-charging operation is carried out with respect to the ground 1 in the vast number of points-charging device 21 of the multi-cylinder pump, complicated vibration is added to the piston rod 36 of each of the unit pumps 22, and there are possibilities that a separating force such as deflection, or deflection may be generated depending on a shape of the cam 24, and that a vertical swinging movement during the operation may be generated, and due to them, there is an undesirable possibility that it is difficult to intake or press the improving material 9 smoothly. In each of the unit pumps 22 of the pump plant 5''' of the multi-cylinder pump 21 of the present invention of this application, since the slide guide 39 as a supporting mechanism is fitted to the slide bar 41 for sliding, a smooth retreating movement of the piston rod 36 of each of the unit pumps 22 is reliably supported so that the vertical swinging movement, deformation, distortion and the like are not generated.

In the intaking and discharging operation of the grout 9 of the improving material, the automatic on-off valve 34 as a suction valve provided in each of the pistons 33 opens the communication hole 35 during the intaking process, to charge the improving material from the intake port 27 from the intake chamber side toward the pressing chamber. In the pressing process, the automatic on-off valve 34 closes the communication hole 35 to press the pressing chamber, and the discharging pressure of the improving material 9 from the ejection post 28 can reliably be held by the piston 33.

In the present embodiment, the improving material transport passage 16 may be of a single-pipe charging method, a plurality of pipe charging method, a Y-shaped pipe type rod, and a double pipe type rod, and may include a packer. The gel time of the improving material 9 can be prepared by appropriately adjusting liquid agent (a) and liquid agent (b) from the improving material tank 6 with respect to the intake port 27 of each of the unit pumps 22.

In this manner, the improving material 9 having a predetermined gel time from a large number of ejection ports 8, 8 . . . in a side direction of the improving material transport passage 16 can be simultaneously or selectively charged into the ground 1 through a vast number of points. A low pressure penetration is conducted with respect to the block A in the ground, the charging operation is not deviated by a swelling of the ground due to cracks or the like based on the conventional technique and a change in properties of each of the stratum of the ground 1. Therefore the ground can be improved as designed.

Next, in an embodiment as shown in FIG. 15, the predetermined number of the improving material transport passages 16, 16 . . . in the block A (the improving material transport passage may be of a single-pipe charging method, a Y-shaped pipe type, and a packer type) are inserted in parallel at a distance from one another into the ground 1 (in this case, the bore is previously formed by a casing pipe which is not shown, the sealing mortar 13 is charged, and the improving material transport passages 16 may be inserted into the sealing mortar 13) to form one wide block A. In this case, the grout 9 of the improving material is simultaneously ejected such that the ejection ports 8 of the adjacent improving material transport passages 16, 16. . . are at the same level. By doing so, the low pressure penetration of the grout 9 of the improving material from each of the ejection ports 8 can be conducted with respect to the stratums of the same level in the one block A, and the improving area 9" of the same level can be formed as designed.

Of course, in this embodiment also, the gel time of the grout of the improving material 9 can appropriately be adjusted.

Figure 16:
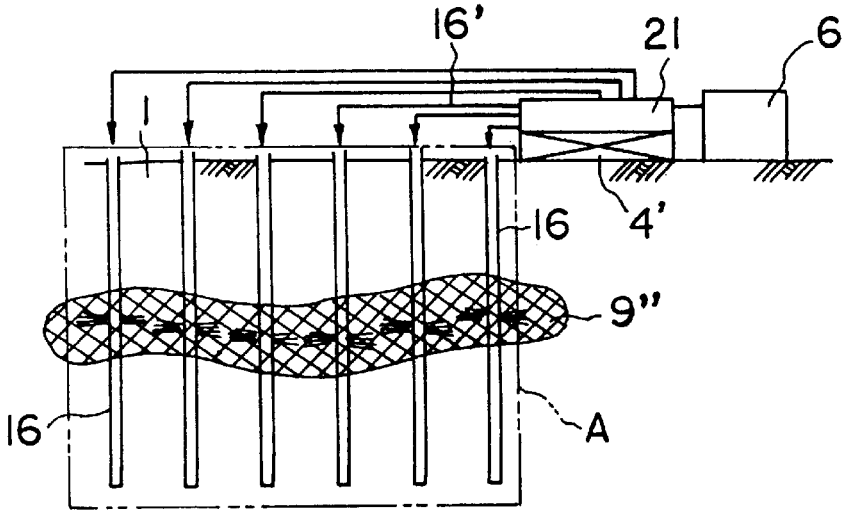
FIG. 16 is a transverse sectional view of the other embodiment.

In an embodiment shown in FIG. 16, an improving area 9" as an application example of the embodiment shown in FIG. 15 is formed into a corrugate shape in the ground in the one block A. A specific stratum of the corrugated stratum can be improved. This embodiment can also be realized by the vast number of points-charging device 21 of the present invention of this application.

Figure 17:
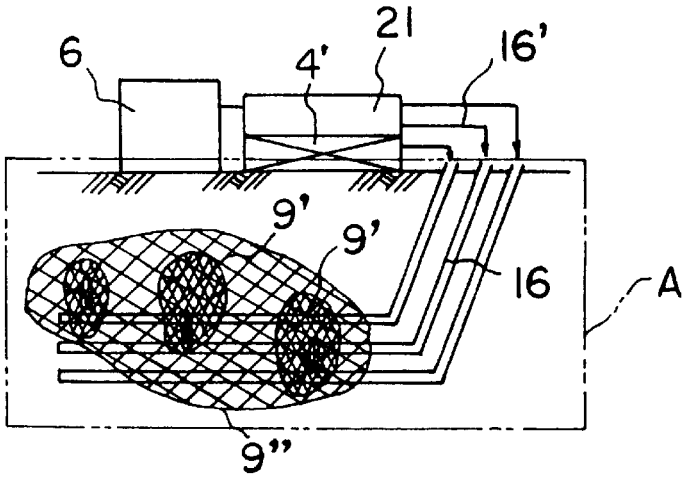
FIG. 17 is a schematic sectional view of a three-dimensional charging operation of the another embodiment.

In an embodiment shown in FIG. 17, if a culvert such as a tunnel is constructed in the one block A in the ground, when the improving area 9" is formed in a horizontal direction in the ground 1, the improving material transport passages 16, 16 are bent laterally from the ground. The improving material 9 is ejected from each of the ejection ports 8 having different position on the improving material transport passages with a horizontal portion. The low pressure penetration improving areas 9', 9' are connected to each other to form the vast number of points improving area 9", and it is a kind of three-dimensional ground improving mode.

Also in the embodiment, the improving material can be charged by the multi-cylinder pump 21 as the above described vast number points-charging device.

Figure 20:
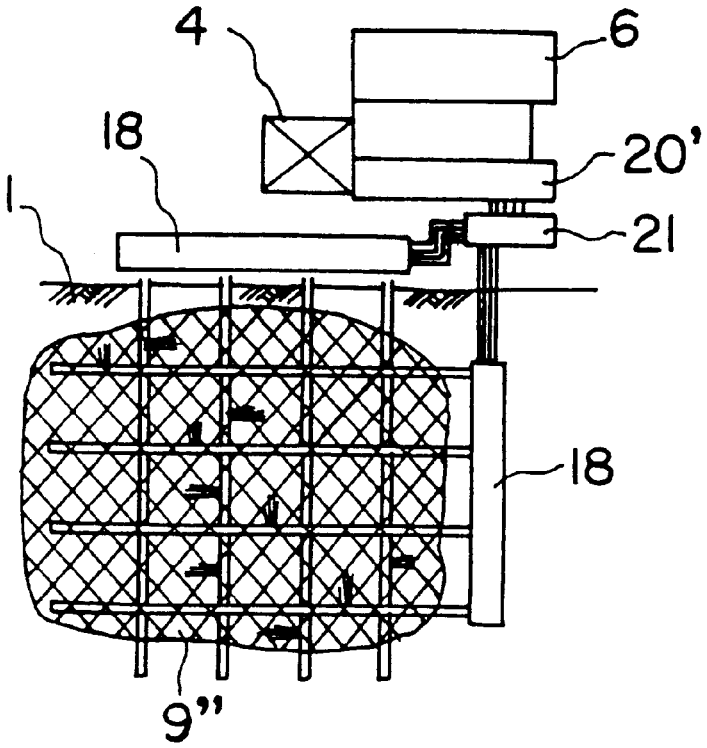
FIG. 20 is a schematic longitudinal sectional view of another embodiment.

In an embodiment shown in FIG. 20, the improving material transport passages 16, 16 . . . are formed in matrix-shape in vertical and horizontal directions in the one block A in the ground 1. The ejection ports 8, 8, 8 . . . face three-dimensionally, and the low pressure penetration improving areas 9" from each of the ejection ports 8 are connected to one another so that the three-dimensional improving area 9" of a corresponding space region can be formed in the one block A in the ground 1. In this mode also, the vertical and lateral improving material transport passages 16, 16 . . . are connected to one another through the headers 18, 18, and a pressure pot 20' can be interposed between the vast number of points-charging pump 21 of multi-cylinder and the improving material tank 6.

Figure 18:
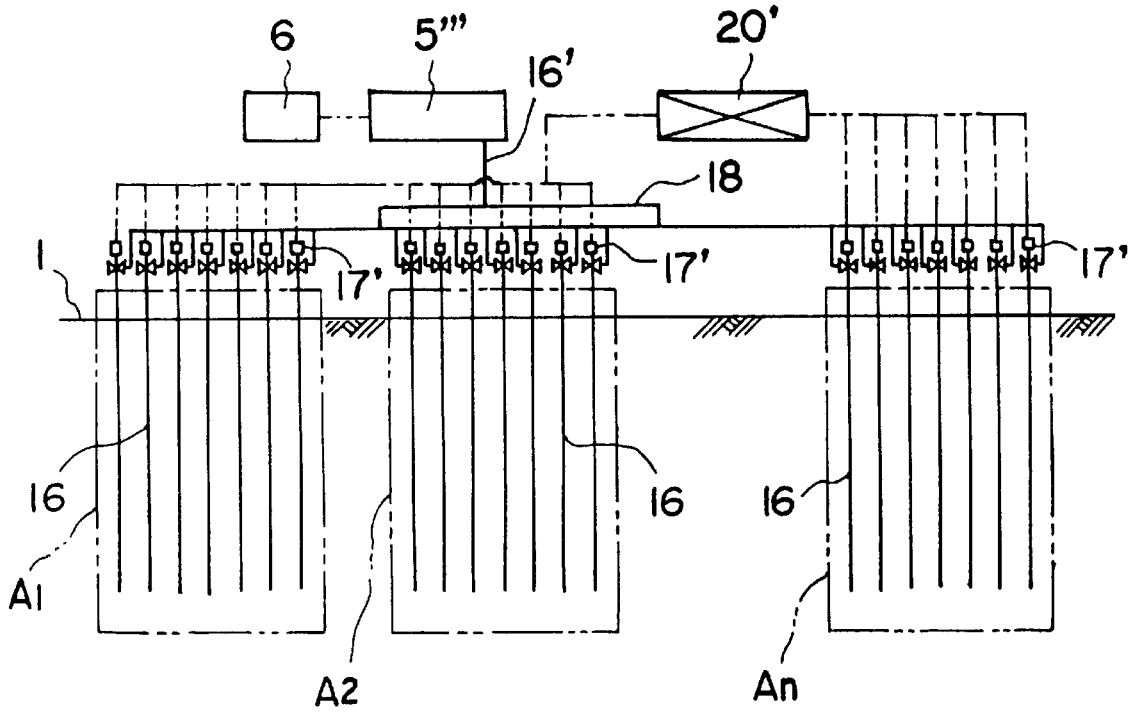
FIG. 18 is a transverse sectional view of another three-dimensional charging operation of the another embodiment.

In the above described embodiments shown in FIG. 1 and FIGS. 15 to 17, the block A of the improving area of the ground 1 is a single, whereas, in the embodiment shown in FIG. 18, a wide region of a predetermined ground 1 is divided into a predetermined number of block unit $A_1$, $A_2$ . . . $A_n$ each having a predetermined area. In each of the blocks $A_1$ to $A_n$, the improving material transport passages 16 are separated at a predetermined distance from one another, or are lowered and banded. With respect to the improving material transport passage 16 of each of the blocks A, an instantly connecting gel time from the improving material tank 6 through the pump plant 5'", or the grout of the improving material of the instantly connecting gel time is supplied under pressure through a solenoid switch valve 17', 17' . . . with respect to each of the improving material transport passage 16 through the header 18, and the conditioner liquid is charged. In this mode, the improving material is supplied under pressure for each of the blocks with respect to the blocks $A_1$, $A_2$ . . . $A_n$ sequentially intermittently. Switching of the electromagnetic switch valve 17 with respect to the improving material transport passage group 16 of the blocks $A_1$, $A_2$ . . . $A_n$ is conducted by the controller 20'. In this embodiment, the conditioner liquid is charged in a wide region with respect to the ground 1, by the pump plant 5' as the vast number of points-charging device of the plant for each of the block units $A_1$, $A_2$ . . . $A_n$, the vast number of points-charging can be conducted simultaneously in parallel and continuously as a total intermittently and selectively with respect to the block units $A_1$, $A_2$ . . . $A_n$ . The switching control of each of the electromagnetic switching valve 17' by the controller 20' appropriately detects the completion of the charging operation of the improving material into the ground by the improving material transport passages 16. If the completion of the charging operation is detected, each of the electromagnetic switching valves 17' of the block units $A_1$, $A_n$ is switched through the controller 20', and next, in order to supply the grout improving material to the adjacent or selected block unit $A_n$, the electromagnetic switch valve 17' of each of the improving material transport passages 16 of the adjacent block unit $A_n$ is opened. A predetermined improving material is supplied under pressure from the improving material tank 6 through the header 18 through the pump plant 5'", and this process is repeated to complete the charging operation to the last block unit $A_n$. In this mode, it is possible to effectively charge the improving material in the improving construction which requires a wide area such as an airport.

Figure 19:
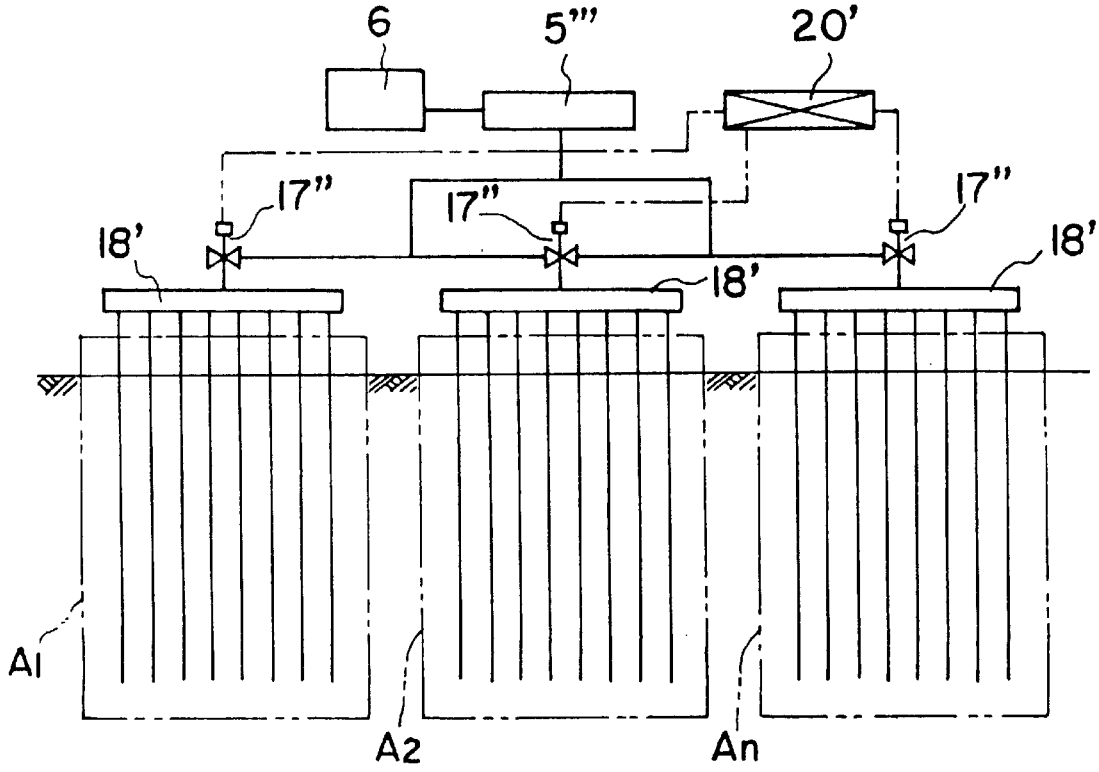
FIG. 19 is a schematic longitudinal sectional view of the another embodiment.

In an embodiment shown in FIG. 19, unlike the embodiment shown in FIG. 18, a header 18' with respect to each of the improving material transport passages 16 of the block units $A_1$, $A_2$ . . . $A_n$ is disposed for every block unit $A_1$, $A_2$ . . . $A_n$. The electromagnetic switching valve 17" is disposed through the controller 20' with respect to each of the headers 18'. The improving material is supplied under pressure from the improving material tank 6 by the pump plant 6'" for every block unit $A_1$ to $A_n$ intermittently, that is selectively. The electromagnetic switching valve 17" of the header 18' of the block units $A_1$, $A_2$ . . . $A_n$ in which the charging operation of improving material by the controller 20' is completed is closed, and next, the adjacent electromagnetic switching valve 17" 17' is opened. The improving material is sent under pressure from the improving material tank 6 to the improving material transport passage 16 of the adjacent block unit $A_n$. The improving material can be charged into the ground 1 having a wide area intermittently, selectively and totally continuously or simultaneously for every block unit $A_n$. In both the embodiments shown in FIGS. 18 and 19, the improving material transport passage may be of a single pipe type, a double pipe type or a Y-shaped pipe type. The improving material may be an instantly connecting gel time or loosely connecting gel time.

The improving material transport passages set in the block units $A_1$, $A_2$ . . . $A_n$ in both of the embodiments may be in modes shown in FIGS. 1 to 3, and can be arranged as in modes shown in FIGS. 12 to 15.

As a modification of both the embodiments, when the switching operation of the electromagnetic switching valve 17 with respect to the improving material transport passages 16 of the block units $A_1$, $A_2$ . . . $A_n$ is conducted by the controller 20', the electromagnetic switching valve 17 is selectively switched with respect to a desired improving material transport passage for every block unit $A_1$, $A_2$ ... $A_n$, the grout 9 of the improving material can be selectively charged under pressure into the ground 1 with respect to the improving material transport passage 16 of the block unit $A_1$, $A_2$ . . . $A_n$ beyond the block unit $A_1$, $A_2$ . . . $A_n$ in accordance with a change in properties of the ground 1 and the state of the stratum.

Therefore, in both the embodiments, the pump plant 5'" may not only be the pump plant 5'" of the pump unit of three or fifty cylinders as shown in FIGS. 6 to 14, and but also be the pump unit having fifty cylinders or more.

In any of the above described embodiments, by removably inserting the clutch bar 47 between the cam 24 and the cam follower tappet 48 through the air cylinder 46 and the like, it is possible to automatically adjust the start and stop of the piston 33 and the stroke, and automatically adjust the advancing and retreating movement of each of the screws 32 of the advancing and retreating movement adjusting device.

The present invention of this application is not be limited to the above described embodiments of course, and it can be variously applied, for example, the driving source of the pump may be of cam type, a crank driven type or a hydraulic pressure driven type.

According to the present invention of this application, in the construction such as an improving construction of basically a soft ground such as rivers, lakes and marshes or shallow sea shores, when the already developed many point-charging is conducted as a vast number of points-charging instead of the conventional spot-charging, the vast number of points-charging can be simultaneously conducted through the low pressure penetration with respect to the ejection ports formed in the improving material transport passages such that their positions are set different in an axial direction for every block unit, or with respect to the ejection ports of the improving material transport passages disposed at a distance from one another. Further, since the gel time of the charging improving material ejected from each of the ejection ports can be adjusted, the ground can be improved simultaneously as designed.

Instead of the conventional spot-charging, the vast number of points-charging can be simultaneously or appropriately selectively conducted sequentially for every block of the ground. Therefore, a three-dimensional charging can be conducted simultaneously or selectively in a wide ground. Further, it can be conducted by the low pressure penetration, the improving material is not leaked through a swell or crack of the ground due to a crack of the ground, pollution is prevented, and assets can be utilized effectively, and cost are kept low so that the construction efficiency is enhanced.

Since the charging operation can be conducted intermittently or continuously for every block, the vast number of points-charging pump of the multi-cylinder type can have at least five or more cylinders, some tens of cylinders continuously connected. Therefore, the vast number of points-charging of the improving material which has not been realized can be realized, the construction effectiveness and efficiency are remarkably enhanced.

Further, since the vast number of points-charging pump has five of more cylinders continuously connected, the grout is charged simultaneously through a plurality of improving material transport passages in one block unit, and the pump can operate stable as a whole.

Irrespective of the multi-cylinder continuously connected type, because of the multi-cylinder of each of the unit pump, it can be manufactured and assembled easily, and its maintenance is also simple, and there is a merit that not only the initial cost but also the maintenance cost is cheap.

Further, in the mode of cam type, with respect to the cam connected to the rotating shaft which is connected to the driving source, a predetermined number of unit pumps are mounted to opposite sides or one cam shaft, and agent (a) and agent (b) having different gel times are for exclusive use, and distribution amount is adjusted and can be intaken or discharged and therefore, the structure is simple, and maintenance such as inspection and servicing is easy.

By providing an advancing and retreating movement adjusting device such as a screw in the cylinder of each of the unit pumps, a stroke including the start and stop of the unit pumps can be adjusted.

When the pump rod of each of the unit pumps receives a bending stress by separating force of the driving mechanism such as a cam, a slide guide is provided as a supporting mechanism in the device frame on the piston rod. Therefore, the advancing and retreating movement of the pump or pump rod can be held smoothly, and the improving material is intaken or discharged as designed.

Since the piston of each of the unit pumps is provided with the automatic on-off valve as a suction valve, the intake and discharge of the improving material can be switched from the intake chamber and the discharge chamber automatically, the improving material of the unit pump is smoothly discharged, and this is extremely effective for ejection of the improving material of the ground improving construction.

By using the vast number of points-charging device of the multi-cylinder continuously connected of the present invention of this application, the improving material can be charged into a plurality of blocks formed in the ground through the vast number of points, i.e., three-dimensionally, which exhibits an excellent effect that a power can be exhibited for a project construction such as wide three-dimensional improving construction such as an airport.

The construction method and device of the present invention of this application can be applied not only to the mere ground improving construction, but also to a construction of marine airport, a marine crossing road, a large-scale wide tunnel construction and the like, and an effective construction can be conducted.

What is claimed is:

1. A method of ejecting a ground improving grout into a ground through a vast number of ejecting points, said method comprising the steps of:

inserting a plurality of ejecting pipes into the ground;

operating a multicylinder pump including a plurality of unit pumps and a plurality of piston driving devices for the unit pumps driven by a single driving source, wherein said plurality of unit pumps are operatively connected to said plurality of ejecting pipes;

transporting the ground improving grout into each of the ejecting pipes under pressure in response to the operation of said plurality of unit pumps of said multicylinder pump; and ejecting the ground improving grout into the ground through a plurality of discharge ports in said plurality of ejecting pipes to stabilize the discharge pressure of the ground improving grout.

2. A method of ejecting a ground improving grout into a ground through a vast number of ejecting points according to claim 1, further comprising the steps of: dividing the ground into single or plural blocks, and inserting at least one of said plurality of ejecting pipes into each said block.

3. A method of ejecting a ground improving grout into a ground through a vast number of ejecting points according to claim 1, further comprising the step of: positioning the discharge ports of said plurality of ejecting pipes at different depths within the ground.

4. A method of ejecting a ground improving ground into a grout through a vast number of ejecting points according to claim 1, wherein said plurality of ejecting pipes are a plurality of slender pipes having parallel longitudinal axes, and wherein said method includes positioning, said slender pipes such that each of the discharge ports of said slender pipes are situated at a different position relative to the other discharge ports along the parallel longitudinal axes of the slender pipes.

5. A method of ejecting a ground improving grout into a ground through a vast number of ejecting points according to claim 4, including the steps of: providing a plurality of check valves on the discharge ports of said ejecting pipes, and filling an opening between the ejecting pipes and the ground with a hardener prior to ejecting the ground improving grout from the discharge ports.

* * * * *